US007111365B1

(12) United States Patent
Howie, Jr.

(10) Patent No.: US 7,111,365 B1
(45) Date of Patent: Sep. 26, 2006

(54) KNOB WITH DECORATIVE RING AND SNAP ON CAP

(75) Inventor: Robert K. Howie, Jr., Decatur, IL (US)
(73) Assignee: The Grigoleit Company, Decatur, IL (US)

( * ) Notice: Subject to any disclaimer, the term of this patent is extended or adjusted under 35 U.S.C. 154(b) by 121 days.

(21) Appl. No.: 10/965,631

(22) Filed: Oct. 14, 2004

(51) Int. Cl.
*E05B 1/00* (2006.01)

(52) U.S. Cl. ..... 16/441; 16/414; 16/417

(58) Field of Classification Search ..... 16/441, 16/414, 417, DIG. 30, DIG. 18; 200/308, 200/315–317; 345/184; 74/553; 362/23, 362/26, 29–30, 100, 501; 116/309, 310, 116/279, 286–287, 284, 302, 304; 267/158, 267/163

See application file for complete search history.

(56) References Cited

U.S. PATENT DOCUMENTS

| | | | | |
|---|---|---|---|---|
| 2,997,592 | A * | 8/1961 | Costello | 250/497.1 |
| 3,313,057 | A * | 4/1967 | Leddy | 40/331 |
| 3,410,247 | A * | 11/1968 | Dronberger | 116/311 |
| 3,413,953 | A * | 12/1968 | Kuhl | 116/336 |
| 3,461,997 | A * | 8/1969 | Humphreys | 400/567 |
| 3,540,673 | A * | 11/1970 | Hunt et al. | 242/118.3 |
| 3,592,206 | A * | 7/1971 | Kitani | 135/76 |
| 3,662,618 | A * | 5/1972 | Kroll et al. | 74/527 |
| 4,510,666 | A | 4/1985 | Howie, Jr. | |
| 4,604,786 | A | 8/1986 | Howie, Jr. | |
| 4,608,882 | A | 9/1986 | Howie, Jr. | |
| 4,657,428 | A | 4/1987 | Wiley | |
| 4,787,216 | A * | 11/1988 | Chesnut et al. | 62/347 |
| 4,796,329 | A * | 1/1989 | Bory | 16/441 |
| 4,920,823 | A * | 5/1990 | Mohr et al. | 74/553 |

(Continued)

FOREIGN PATENT DOCUMENTS

| | | | |
|---|---|---|---|
| DE | 2700078 | A * | 7/1978 |

(Continued)

*Primary Examiner*—Chuck Y. Mah
(74) *Attorney, Agent, or Firm*—Cook,Alex,McFarron,Manzo,Cummings & Mehler, Ltd.

(57) ABSTRACT

A multi-piece knob having a cylindrical tubular plastic body with a central hub and a peripheral wall. An annular end wall extends from the peripheral wall and terminates radially short of the central hub to define a passage into the tubular body and around the hub. An undersurface is formed on the annular end wall at the annular passage. An annular ring is seated on the annular end wall of the cylindrical tubular body between the passage and the peripheral wall. A locking top cap is formed having a head with an underside. A number of discrete elongated fingers are formed integrally with the underside of the head of the locking top cap with the elongated fingers spaced from each other and arranged generally in a circle. The elongated fingers extend from the underside of the top cap with each of the fingers terminating in a tip. The locking top cap is positioned on the annular ring with its elongated fingers extending through the annular ring and through the passage in the annular end wall of the tubular body to engage and surround the hub of the cylindrical tubular body. Each of the elongated fingers has a locking lug located between its tip and the underside of the top cap head to engage the underside of the annular end wall of the cylindrical tubular body to connect the cylindrical tubular body, the annular ring and the locking top cap to one another. The locking lug has an inclined locking ledge which engages the undersurface of the annular end wall to provide a connection which automatically adjusts to compensate for temperature changes. The annular ring may be formed of either metal or plastic.

11 Claims, 2 Drawing Sheets

U.S. PATENT DOCUMENTS

| | | | | |
|---|---|---|---|---|
| 5,509,174 | A | | 4/1996 | Worrell |
| 5,519,972 | A | | 5/1996 | Howie, Jr. |
| 6,086,284 | A | | 7/2000 | Callahan |
| 6,091,831 | A | * | 7/2000 | Cho ..... 381/365 |
| 6,242,064 | B1 | | 6/2001 | Howie, Jr. |
| 6,347,784 | B1 | * | 2/2002 | Philipps-Liebich et al. ... 251/92 |
| 6,463,630 | B1 | | 10/2002 | Howie, Jr. |
| 6,528,001 | B1 | | 3/2003 | Howie, Jr. |
| 6,591,457 | B1 | | 7/2003 | Howie, Jr. |

FOREIGN PATENT DOCUMENTS

| | | | | |
|---|---|---|---|---|
| JP | 10326536 | A | * | 12/1998 |
| JP | 2000100269 | A | * | 4/2000 |
| JP | 2004338482 | A | * | 12/2004 |

* cited by examiner

Fig. 1
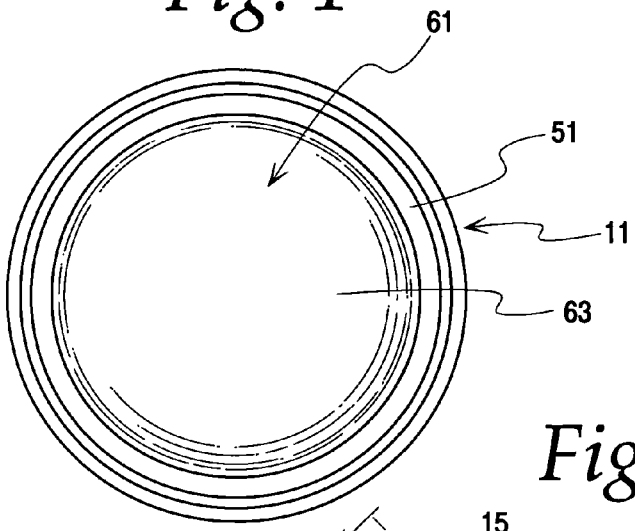
Fig. 2
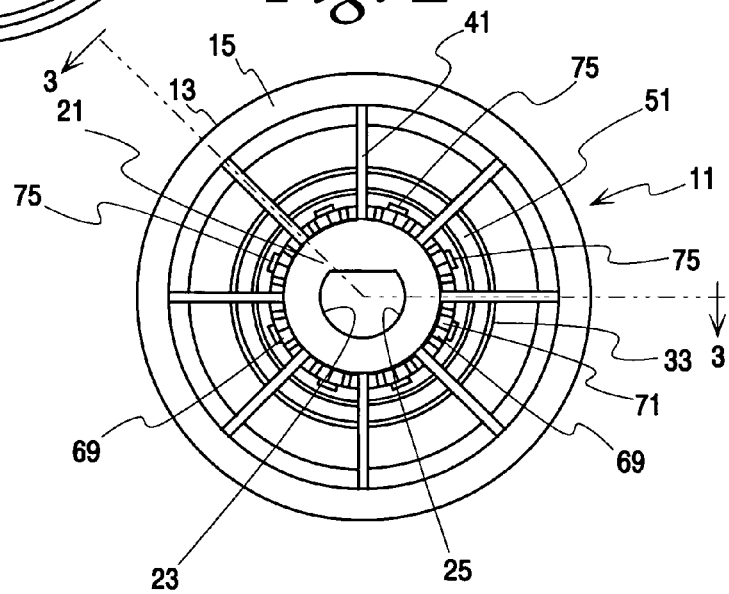
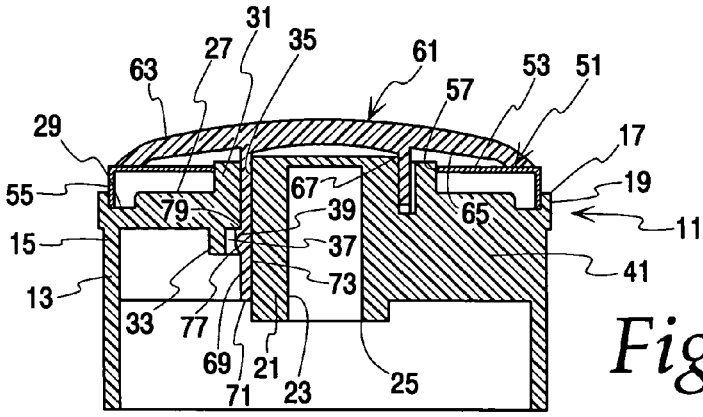
Fig. 3

KNOB WITH DECORATIVE RING AND SNAP ON CAP

BACKGROUND AND SUMMARY OF THE INVENTION

This invention is directed to a snap fitted multi-piece knob in which a locking cap connects to a tubular plastic body and captures a decorative ring between the locking cap and the tubular body.

An object of this invention is a multi-piece snap fitted knob in which the components of the knob are held together under a constant clamping force over a wide range of environmental operating temperatures.

Another object of the invention is a multi-piece knob having a locking cap having fingers that pilot the locking cap into its locking position.

Yet another object of this invention is a decorative ring of a multi-piece knob which is held against rotation relative to the knob's tubular body.

Still another object of this invention is a multi-piece knob which may incorporate a metal or a plastic decorative ring.

Other objects of the invention will be found in the following specification, claims and drawings.

BRIEF DESCRIPTION OF THE DRAWINGS

The invention is illustrated more or less diagrammatically in the following drawings wherein:

FIG. 1 is a top plan view of the assembled multi-piece knob of this invention;

FIG. 2 is a bottom view of the knob of FIG. 1;

FIG. 3 is a cross sectional view taken along line 3—3 of FIG. 2;

DESCRIPTION OF THE PREFERRED EMBODIMENTS

Figure 4:
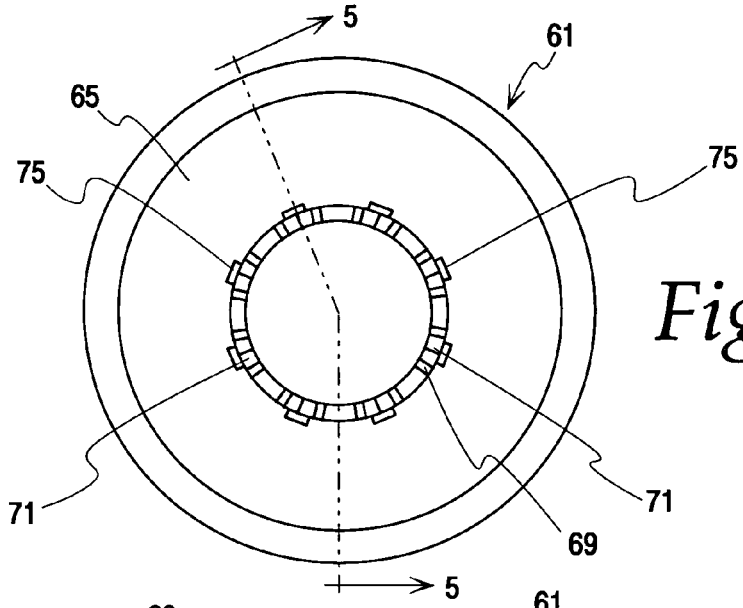
FIG. 4 is an enlarged bottom plan view of the locking cap.

FIGS. 1 to 5 of the drawings show a first embodiment of the invention in a multi-piece knob 11. The knob includes a plastic tubular body 13 which is conventionally injection molded of a suitable plastic. The body is formed with a peripheral wall 15 with a slightly projecting enlarged band 17 located at what will be the front end of the knob when the knob is installed on a shaft. The band is knurled at 19 for gripping purposes. Also formed as part of the tubular body 13 is a central hub 21 having a shaft receiving socket 23 at the end of the tubular body 13 opposite to the projecting enlarged band 17. The socket is shown herein as conventional D-shaped socket but other socket cross-sections may be provided. The socket has an entrance 25 for receiving the end of a shaft. An annular end wall 27 is formed integrally with the tubular body 13. An annular outwardly opening groove 29 is formed in the annular end wall 27 immediately radially inwardly of the enlarged band 17. An upstanding collar 31 is formed at the inner periphery of the annular end wall 27. A downwardly extending annular sleeve 33 is formed at the inner periphery of the annular end wall 27. The collar 31 of the annular end wall 27 and the central hub 21 define an annular passage 35 into the tubular body 13 around the hub 21. An undercut 37 is formed in the annular end wall 27 creating a lug engaging undersurface 39. Ribs 41 are formed to connect the hub 21, peripheral wall 15 and the annular end wall 27 of the tubular body 13. Whereas, for clarity of illustration, the peripheral wall 15, central hub 21, annular end wall 27 and ribs 41 are shown as molded integrally as part of the plastic tubular body 13, it should be understood that all or some of these parts may be formed separately and assembled to form the tubular body 13. Additionally, one or more of these components may be formed by multi-shot molding techniques.

As shown most clearly in cross-section in FIG. 3 of the drawings, an annular metal ring 51 is depicted which ring includes a top annular wall 53 and a shallow outer skirt 55 which skirt seats in the groove 29 of the annular end wall 27 of the tubular body 13. The ring has an inner periphery 57 which may be provided with teeth (not shown) formed thereon which teeth engage the upstanding collar 31 formed on the tubular body 13 to prevent rotation of the ring relative to the tubular body 13 when the ring is positioned on the annular end wall 27.

Figure 5:
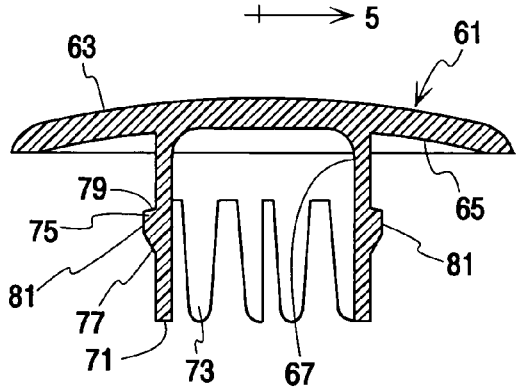
FIG. 5 is a cross-sectional view taken through line 5—5 of FIG. 4.

A locking top cap 61 is shown in its assembled position in FIGS. 1–3 of the drawings and unassembled in FIGS. 4 and 5 of the drawings. The locking top cap 61 includes a head 63 which is somewhat concave on its outer surface and somewhat convex on its undersurface 65. A short tubular base 67 extends from the undersurface 65 of the head 63 of the locking top cap 61. Discrete elongated fingers 69 are formed on the tubular base and arranged in a circle. Each of the elongated fingers 69 ends in a tip 71. While is it preferred that the locking lugs be located intermediate the base and that tip of each finger, the lugs may be located at the tip of each finger. The elongated fingers have inner walls 73 and locking lugs 75 on the exterior of each finger intermediate the tubular base 67 and the finger tips 71. Each locking lug includes an inclined ramp located facing its finger tip 71, a ledge 79 facing the short tubular base 67 and an outer surface 81 extending between the ramp 77 and the ledge 79. It should be noted that the ledge 79 is tilted at an angle of approximately 15 degrees relative to the longitudinal length of its finger.

Figure 6:
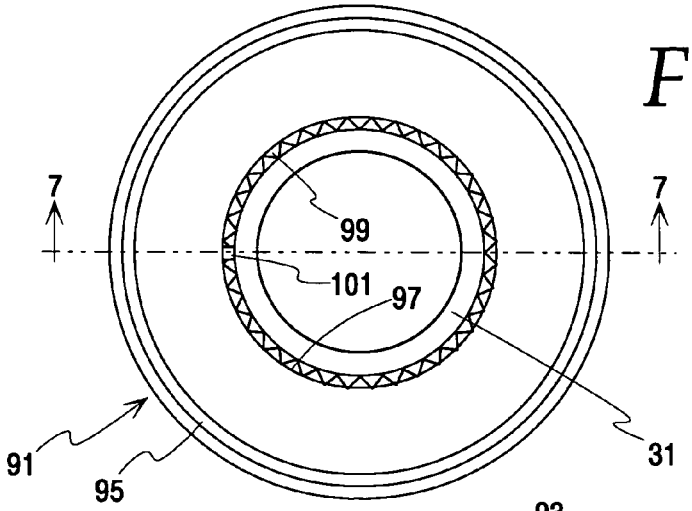
FIG. 6 is a top plan view of a plastic decorative ring positioned on the knob base.
Figure 7:
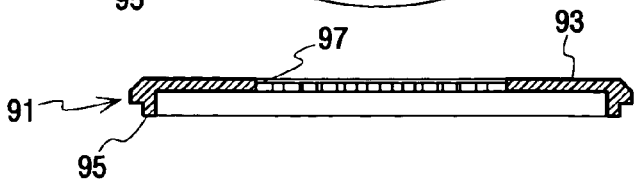
FIG. 7 is a cross sectional view taken along line 7—7 of FIG. 6.

FIGS. 6 and 7 of the drawings show a plastic ring 91 which may be used instead of the metal ring 51. The ring 91 is formed with a planar top wall 93, a shallow peripheral skirt 95 and an inner perimeter wall 97. Teeth 99 are formed on the inner perimeter 97 of the plastic ring and extend from the underside of the top wall 93 terminating short of the upper surface of this wall. As is best shown in FIG. 6 of the drawings, the plastic ring fits over the upstanding collar 31 of the tubular body 13 and is locked in a position against rotation relative to the tubular body by a protrusion 101 formed on the outer surface of the collar 31 and engageable between a pair of teeth 99.

The tubular body 13, ring 51 or 91 and the locking top cap 61 may be individually produced prior to assembly or, if a plastic ring such as ring 91 is used, it may be formed with the locking top cap in a multi-step molding sequence. Upon assembly, the ring 51 or 91 is placed over the annular end wall 27 of the tubular body 13 with the shallow outer skirt 55 or 95 located in the annular groove 29 in the end wall 27. The inner periphery of the ring, 57 or 97, engages the upstanding collar 31 formed on the tubular body 13 to position the ring 51 or 91 in proper alignment with the tubular body 13. The teeth on the inner periphery of the ring 61 or the teeth 99 on the inner periphery 97 of the ring 91 engage a protrusion 101 formed on the collar 31 to lock the ring against rotation.

The locking top cap 61 is located next to the tubular body 13 outwardly of the ring 51, 91 with the elongated fingers 69 of the locking top cap aligned with the annular passage 35 into the tubular body 13 around the central hub 21. As the locking top cap is moved towards contact with the respective top wall 53, 93 of the ring 51 or 91 which is being captured, the inner walls 73 of the fingers 69 may pilot on the outer surface of the central hub 21. At the same time, the inclined ramps 77 of the locking lugs 75 of the elongated fingers 69 contact the upstanding collar 31. When the inclined ledges 79 are slid into the annular passage 35 past the locking underside 39 formed by the undercut 37 of the annular end wall 27 of the tubular body 13, the elongated fingers of the locking top cap are locked into engagement with the underside 39. The inclination of the ledge 79 on the locking lug 75 of each finger 69 provides a limited degree of axial movement for the assembled parts of the knob. The locking top cap 61, decorative ring 51 or 91 and the tubular body 13 will be able to expand and contract relative to each other without allowing the connection between these parts to become loose or overly tightened as the temperature of the environment to which the knob is exposed varies.

Whereas, only a single ring 51 or 91 has been shown assembled in the multi-piece knob 11, it should be understood and appreciated that multiple rings may be captured between the tubular body 13 and the top locking cap 61 without departing from the teachings of this invention.

The invention claimed is:

1. A multi-piece knob comprising:

a cylindrical tubular plastic body having a central hub and formed with a peripheral wall, an annular end wall extending from said peripheral wall and terminating short of said central hub to define a passage into said tubular body and around said hub, an undersurface formed on said annular end wall at said annular passage, an annular ring located outwardly of said annular end wall of said cylindrical tubular body, and a top cap having a head, with said head having an underside, a plurality of elongated fingers formed integrally with said head of said top cap, said elongated fingers spaced from one another generally in a circle and extending from said underside of said top cap with each of said elongated fingers terminating in a tip, said top cap positioned outwardly of said annular ring with said elongated fingers extending through said annular ring and through said passage in said annular end wall to engage and surround said hub of said cylindrical tubular body, each of said elongated fingers having a locking lug to engage said undersurface of said annular end wall of said cylindrical tubular body to connect said cylindrical tubular body, said annular ring and said top cap to one another.

2. The multi-piece knob of claim 1 in which each of said locking lugs of each of said elongated fingers is located between the tip of each finger and said underside of said top cap.

3. The multi-piece knob of claim 1 in which said locking lugs include inclined ledges which engage the said undersurface of said annular end wall.

4. The multi-piece knob of claim 1 in which said annular ring is formed of metal.

5. The multi-piece knob of claim 1 in which said annular ring is formed of plastic.

6. The multi-piece knob of claim 1 in which said annular ring includes a shallow depending skirt which faces said annular end wall of said cylindrical tubular body.

7. The multi-piece knob of claim 6 in which an annular groove is formed in said annular end wall, said annular ring includes a shallow depending skirt and said shallow depending skirt seats in said annular groove.

8. The multi-piece knob of claim 1 in which a collar is formed on said annular end wall surrounding said passage and an inner periphery is formed on said annular ring to engage said collar.

9. The multi-piece knob of claim 8 in which teeth are formed on said inner periphery of said annular ring and said teeth engage a protrusion formed on said collar to lock said annular ring against rotation.

10. The multi-piece knob of claim 1 in which said annular ring is seated on said annular end wall of said cylindrical tubular body between said passage and said peripheral wall.

11. The multi-piece knob of claim 1 in which said top cap is positioned against said annular ring.

* * * * *

UNITED STATES PATENT AND TRADEMARK OFFICE

CERTIFICATE OF CORRECTION

PATENT NO. : 7,111,365 B1
APPLICATION NO. : 10/965631
DATED : September 26, 2006
INVENTOR(S) : Robert K. Howie, Jr.

It is certified that error appears in the above-identified patent and that said Letters Patent is hereby corrected as shown below:

Claim 7 column 4 line 27 should read:

"The multi-piece knob of claim "6" - 1 - in which an annular groove is formed in said annular end wall, such annular ring includes a shallow depending skirt and said shallow depending skirt seats in said annular groove."

Signed and Sealed this

Fifth Day of December, 2006

JON W. DUDAS
*Director of the United States Patent and Trademark Office*